US007540777B2

(12) United States Patent
Lappoehn

(10) Patent No.: US 7,540,777 B2
(45) Date of Patent: Jun. 2, 2009

(54) PLUG-IN CONNECTOR FOR CONNECTING ELECTRONIC COMPONENTS

(75) Inventor: Juergen Lappoehn, Gammelshausen (DE)

(73) Assignee: ERNI Electronics GmbH, Adelberg (DE)

( * ) Notice: Subject to any disclaimer, the term of this patent is extended or adjusted under 35 U.S.C. 154(b) by 0 days.

(21) Appl. No.: 11/608,102

(22) Filed: Dec. 7, 2006

(65) Prior Publication Data

US 2007/0134982 A1 Jun. 14, 2007

(30) Foreign Application Priority Data

Dec. 13, 2005 (DE) ..... 10 2005 059 990

(51) Int. Cl.
*H01R 13/648* (2006.01)

(52) U.S. Cl. ..... 439/607; 439/108

(58) Field of Classification Search ..... 439/607–609, 439/108, 109, 83
See application file for complete search history.

(56) References Cited

U.S. PATENT DOCUMENTS 4,307,242 A 12/1981 Shah et al.
4,959,024 A * 9/1990 Czeschka ..... 439/607
5,030,140 A * 7/1991 Sugiyama ..... 439/607
5,035,631 A * 7/1991 Piorunneck et al. ..... 439/108
5,037,330 A * 8/1991 Fulponi et al. ..... 439/607
6,305,982 B1 10/2001 Wu et al.
6,478,623 B1 * 11/2002 Wu ..... 439/607
6,623,301 B2 * 9/2003 Lappoehn ..... 439/607
6,749,463 B1 * 6/2004 Fan ..... 439/607

FOREIGN PATENT DOCUMENTS

DE 19907635 C1 9/2000
EP 1251591 A2 10/2002

* cited by examiner

*Primary Examiner*—Truc T Nguyen
*Assistant Examiner*—Xuong M Chung-Trans
(74) *Attorney, Agent, or Firm*—Collard & Roe, P.C.

(57) ABSTRACT

A plug-in connector for connecting electronic components, comprising a multi-point pin connector element and a multi-point socket connector element. The multipoint pin connector element and the multipoint socket connector element being each provided with an electric screening in the form of at least one screening sheet that can be fixed on the multipoint pin connector element or the multipoint socket connector element, respectively, via snap-in connections. The screening sheets comprising projecting soldered connections in the snapped-in condition and the respective screening sheets being in predominantly flat contact one with the other by their body surfaces facing each other, characterized in that the screening sheets of the multipoint pin connector element comprise at least two rows of snap-in connections that are arranged at a spacing one above the other.

12 Claims, 4 Drawing Sheets

PLUG-IN CONNECTOR FOR CONNECTING ELECTRONIC COMPONENTS

SPECIFICATION

The present invention relates to a plug-in connector for connecting electric components.

A plug-in connector of that species has been known from EP 1 251 591 A2. Such plug-in connectors comprise two plug-in connection elements that can be engaged one into the other. They comprise a plurality of electrically conductive contacts capable of establishing electrically conductive connections. Such plug-in connectors are used especially for SMD ("surface-mounted device") connectors and are mounted on printed-circuit boards. For this purpose, one of the two plug-in connector elements is fixed on one printed-circuit board while the other one of the two plug-in connectors is fixed on another printed-circuit board. The plug-in connectors thus serve to electrically connect different printed-circuit boards which, especially, may be arranged one above the other. The plug-in connector disclosed by EP 1 251 591 A2 thus allows electric contact to be established between two printed-circuit boards that are arranged at a given level one above the other, as defined by the plug-in connector.

Depending on the height of the devices mounted on the printed-surface board, it is then necessary to adapt the spacing of the printed-surface boards arranged one above the other in order to adjust it to the height of the devices. This in turn creates a need for connectors of greater overall height.

The height of the plug-in connectors required in such cases may be several times the height of the plug disclosed in EP 1 251 591 A2. Now, it is not possible without any difficulty to simply increase the length of the plug known from EP 1 251 591 A2 because the arrangement of the screening sheet, especially, in the multipoint pin connector element would be problematic in this case. In the case of the plug-in connector of the prior art, the screening sheet is fixed on the printed-surface board by soldering and on the plug-in connector element on the side opposite the printed-surface board by snap-in connections. In the case of a multipoint pin connector element of very great overall height, where the screening sheet extends over the full length in the multipoint pin connector element, such a fixing arrangement may lead to instabilities that may impair the screening effect.

Now, it is the object of the present invention to improve a plug-in connector of the above-mentioned kind so that fixing of the screening sheets in the multipoint pin connector element will be improved even in the case of plug-in connectors of great overall height with multipoint pin connector elements of great height, so that the soldered connections of the screening sheets on the printed-circuit board are relieved.

DESCRIPTION OF THE ADVANTAGES OF THE INVENTION

According to the invention, that object is achieved by a plug-in connector for connecting electronic components described herein.

Advantageous further developments and embodiments of the invention are the subject-matter of the sub-claims.

The basic idea of the invention is seen in the fact that in the case of plug-in connectors of great height the screening sheets of the multipoint pin connector element are fastened on the multipoint pin connector element by means of at least two rows of snap-in connections arranged at a spacing one above the other. The at least two rows of snap-in connections arranged one above the other allow very strong fixing on the multipoint pin connector element to be realized whereby the soldered connections between the screening sheets and the printed-circuit board are relieved. This considerably reduces the risk of failure, even in case the two plug-in connector elements are repeatedly plugged together and detached again.

For fitting the pins in the multipoint socket connector element, the multipoint socket connector element is provided with a receiving space into which the multipoint pin connector element can be introduced. The pins of the multipoint pin connector element then project from the bottom of the base surface of the receiving space, defining the receiving space, and into the latter where they are contacted by the sockets provided in the multipoint socket connector element.

According to an advantageous embodiment of the invention it is now provided that a first row of snap-in connections is arranged at the level of an entry opening of that receiving space and that at least one further row of the snap-in connections is arranged at the level of the bottom surface that delimits the receiving space. This ensures secure mounting of the screening sheets in the receiving space which is exposed to particularly high stresses.

Preferably, the screening sheets are arranged in receiving pockets which are especially adapted to them and which are formed in the multipoint pin connector element from where they project so that they come to be positioned on the insides of the receiving space. Due to that arrangement of the screening sheets in the receiving pockets, in combination with the row of snap-in connections in the area of the bottom or base surface delimiting the receiving space and a further row at the level of the entry opening of the receiving space, sturdy fixing of the screening sheets on the multipoint pin connector element is achieved even in the case of multipoint pin connector elements of very great overall height, and as a result thereof the desired relief of the screening sheets is realized due to their soldered connection with the printed-circuit board.

With respect to the snap-in connections, the most different configurations are in principle imaginable. A very advantageous embodiment provides that the snap-in connections comprise hook-like projections formed on the screening sheets and openings formed in the multipoint pin connector element that are adapted to such projections. The hook-like projections, which also may be described as snap-in hooks, make assembly especially easy and fast while simultaneously providing sturdy attachment of the screening sheets on the multipoint pin connector element.

In principle, it is possible for the hook-like projections to point in different directions. Preferably, however, the hook-like projections, the snap-in hooks, extend in the same direction in parallel one to the other. This is a particular advantage not only as regards their production but also with respect to assembly of the screening sheets on the multipoint pin connector element.

An especially sturdy attachment that makes any tilting of the screening sheets in the receiving pockets provided for them almost impossible provides that the hook-like projections of the screening sheet associated to the multipoint pin connector element project on both sides of the screening sheet. This allows sort of a hooking effect between the screening sheet and the multipoint pin connector element in two directions in space, which prevents any movement of the multipoint pin connector element in the receiving pockets thereby providing a very sturdy and wobble-free connection between the screening sheets and the multipoint pin connector element.

In principle, it would be possible to mount the hook-like projections on the screening sheets as an additional component. According to an especially advantageous embodiment it is, however, provided that the hook-like projections are formed as an integral part of the screening sheet.

For contacting the screening sheets on the printed-circuit board, so-called SMD or THR contacts are preferably formed on a printed-circuit board for electrically contacting the respective screening sheet on a printed-circuit board on which the plug-in connector element is arranged.

The screening sheets as such preferably are likewise formed as one single piece, which considerably simplifies both their production and their assembly.

DRAWING

Further details, features and advantages of the invention are the subject of the specification that follows and are illustrated in the drawing showing one embodiment of the invention.

DESCRIPTION OF THE EMBODIMENTS

Figure 1:
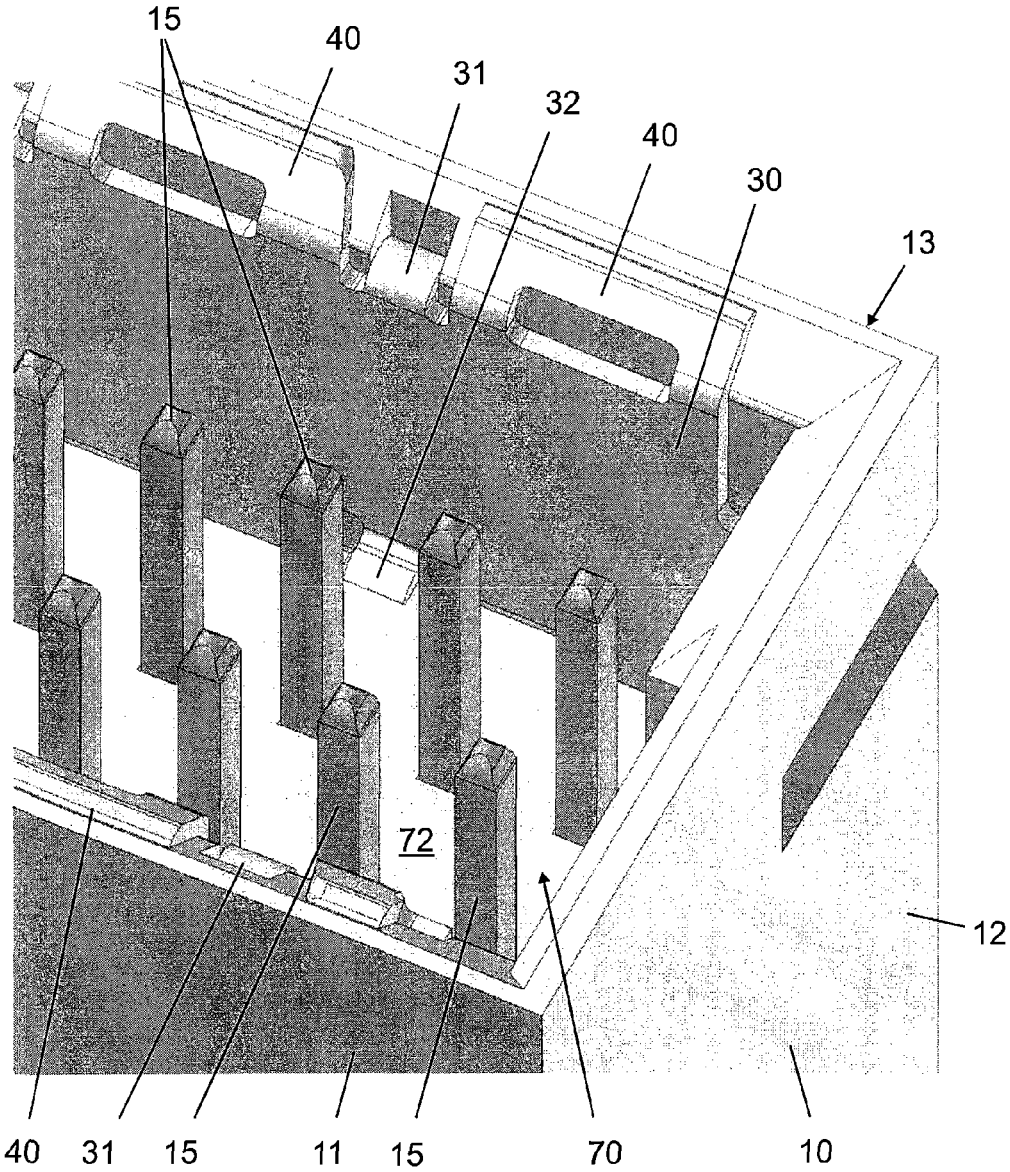
FIG. 1 shows a three-dimensional representation of a multipoint pin connector element of a plug-in connector using the invention.
Figure 2:
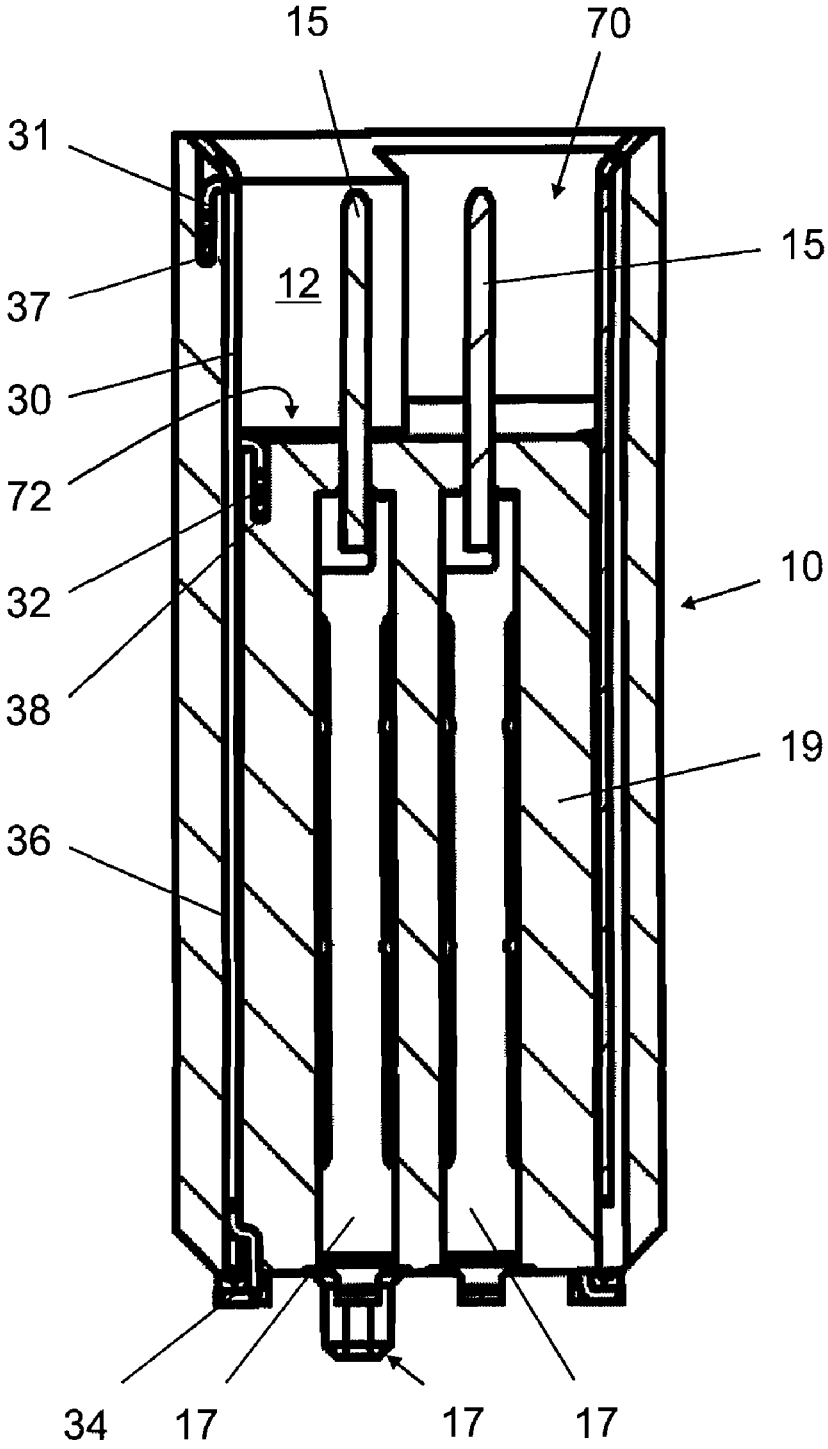
FIG. 2 shows a section through the multipoint pin connector element illustrated in FIG. 1.
Figure 3:
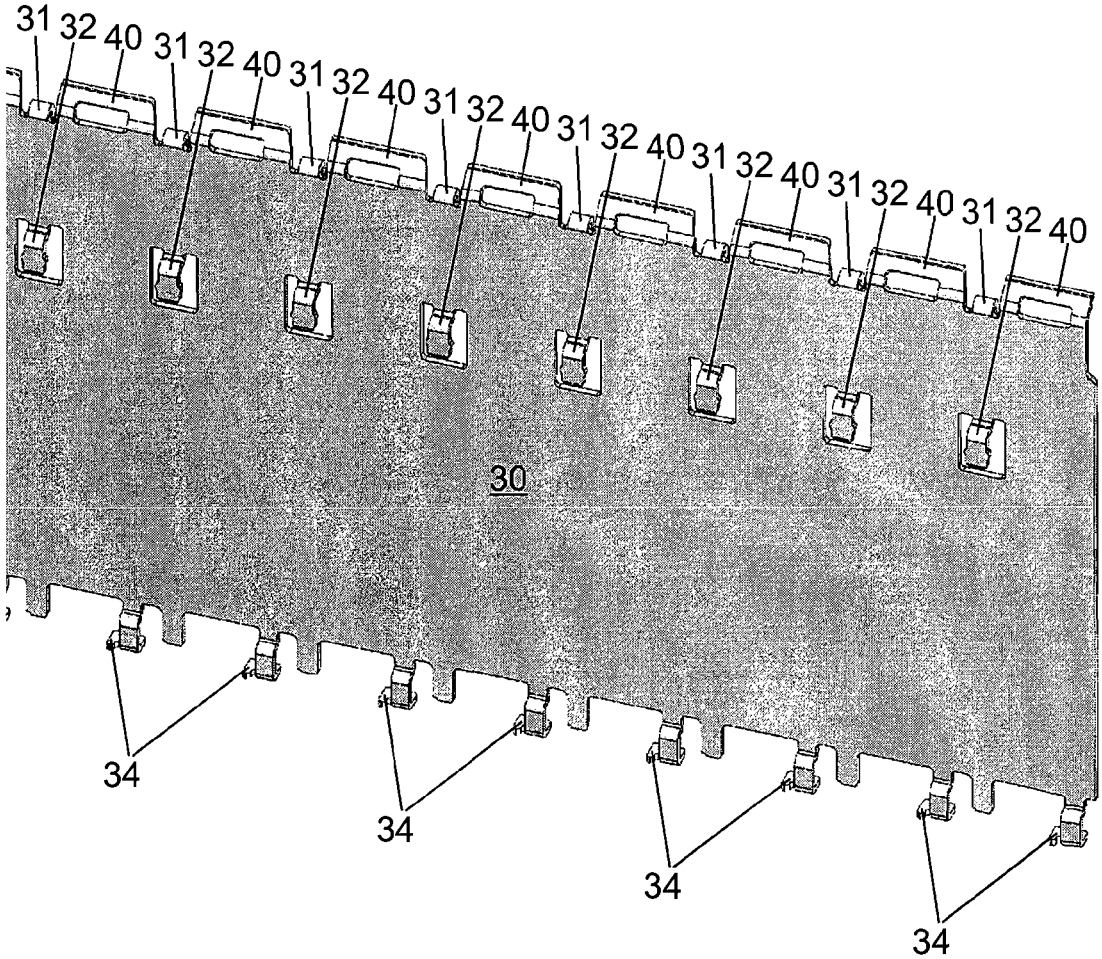
FIG. 3 shows a screening sheet of the multipoint pin connector element illustrated in FIGS. 1 and 2.
Figure 4:
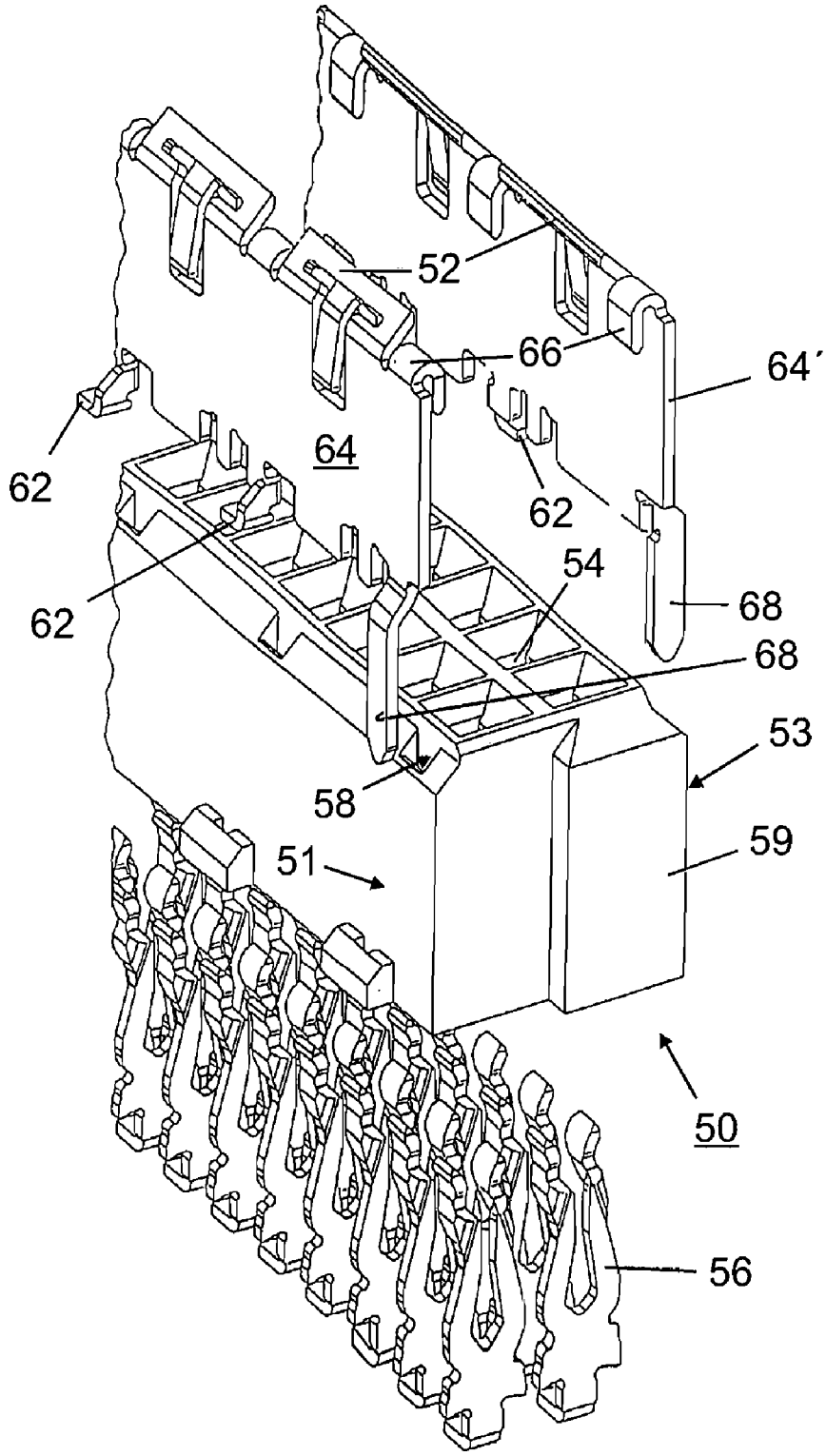
FIG. 4 shows an exploded view of an associated multipoint socket connector element.

A multipoint pin connector element 10, illustrated in FIG. 1 and FIG. 2, comprises an injection-molded plastic part having side walls 11, 13, two end faces 12 of which only one is shown in FIGS. 1 and 2, and a base surface 72 defining a receiving space 70. The receiving space is adapted to a multipoint socket connector element that will be described hereafter in more detail.

As can be seen especially in FIG. 2, the multipoint pin connector element has a very great overall height. That height is necessary for connection of, for example, two printed-circuit boards on which devices of very great height are mounted. The pins 15, also known as contact pins, are arranged in the known way in the receiving space 70. To this end, a solid base body 19 of the multipoint pin connector element 10 comprises openings in which are arranged conductor sheets 17 that are connected with the pins 15 in an electrically conductive way. The screening sheets 17 as such are contacted on the printed-circuit board (not shown) on their side facing away from the pins 15; they serve to connect the pins 15 with the contact surfaces on the printed-circuit board, thereby sort of bridging the height of the multipoint pin connector element 10. The solid base body 19 is provided with receiving pockets 36 in which screening sheets 30 are arranged in a way that will be described hereafter.

A screening sheet 30 of the described kind consists of a metallic body whose lower end is provided with soldered connections 34 that permit contacting on corresponding soldering pads on a printed-circuit board, for example using the SMD or TMR technology.

On the side facing away from the soldered connections 34, the screening sheet 30 comprises inclined sections 40 which, as shown in FIG. 1, form a funnel-like entry opening into the receiving space 70.

Between the inclined sections 40, there is provided a first row of first snap-in elements in the form of snap-in hooks 31 that engage corresponding recesses/openings 37 in the body 19 in the way of snap-in hooks.

A second row of such snap-in connection elements in the form of snap-in hooks 32 is provided at a spacing below the said first row of snap-in hooks 31. As can be seen especially in FIG. 1 and FIG. 2, the spacing of the second row of snap-in hooks 32 is selected so that the snap-in hooks will engage into recesses/openings 38 in the base body 19, especially adapted to them, substantially at the level of the base surface 72 of the receiving space 70. The snap-in hooks 31 of the first row are directed in a different, opposite sense relative to the snap-in hooks 32 of the second row. The snap-in hooks 31 and 32 of one row, respectively, are arranged one parallel to the other, and the snap-in hooks 31 of the first row and the snap-in hooks 32 of the second row also extend in parallel one to the other. It is, however, understood that the invention is not limited to that arrangement. For example, the snap-in hooks 31 and 32, respectively, may also be provided in oblique orientation one relative to the other. Even a change of orientation between the different snap-in hooks, or the snap-in hooks of the two rows, would be imaginable.

By arranging the snap-in hooks 31 and 32, respectively, in two opposite directions, as illustrated in FIG. 2, where the snap-in hooks 31 project toward the left side while the snap-in hooks 32 project toward the right side, particularly sturdy mounting of the screening sheet 30 in the base body 19 of the multipoint pin connector element 10 is achieved. Due to this arrangement, the screening sheet 30 is sort of "clenched up" in the base body 19. This stabilizes the screening sheet 30 and fixes it on the multipoint pin connector element 10. The multipoint pin connector element 10 in its turn is fixed on the printed-circuit board (not shown) via snap-in connections or the like that are known as such. This way of mounting substantially relieves the soldered connections 34. Although the soldered connections 34 also serve for fastening the screening sheets, in addition to establishing electric contacts, the screening sheets 30 are fastened in the illustrated embodiment in a total of three planes, namely the plane of the soldered connections 34, the plane of the second row of snap-in hooks 32 and the plane of the first row of snap-in hooks 31, the fact that the screening sheets are fastened in two planes already securing the sheets in their position in a way that fully relieves the soldered connections 34 so that contrary to the plug-in connectors known from the prior art the soldered connections do not have to fulfill a stabilizing function in the described multipoint pin connector element according to the invention. It is understood that the invention is not limited to two rows of snap-in hooks but that in principle further rows of snap-in hooks may be provided. Whether or not any further rows of such snap-in connections are provided also depends on the overall height of the multipoint pin connector element 10. The higher the multipoint pin connector element 10, the more rows may be provided in order to secure sturdy attachment of the screening sheets 30 on the base body 19 of the multipoint pin connector element 10.

The screening sheets 30 project from the receiving pockets into the receiving space 70 so that they are positioned directly before its side walls 11,13. In this way, screening of the receiving space 70 is achieved. The projecting screening walls of the screening sheets 30 are contacted by the screening sheets of the multipoint socket connector element to be described hereafter.

FIG. 2 shows an exploded view of an associated multipoint socket connector element 50. The multipoint socket connector element exhibits a symmetric configuration adapted to the receiving space 70 of the multipoint pin connector element. It is likewise formed by a body with side walls 51, 52 and end faces 59, provided with passages 54 through the lower and upper surface of the body for positioning the sockets 56 and for introducing the pins 15 when the latter are plugged in. The sockets 56 can be fixed via a snap-in connection. The outsides of the side walls 51, 53 of the multipoint socket connector element 50 are in direct contact with the screening sheets 64, the screening sheets 64 being provided with soldered connections 68. Here again, the screening sheets 64 can be fixed by means of snap-in connections in the form snap-in hooks 56 that can be engaged in recesses 58 in the multipoint socket connector element 50. Projections 62 provided on the screening sheets 64 are inclined toward the center, i.e. in the direction of the plane of symmetry of the multipoint socket connector element 50 so that the projections 62 assume a conical/pyramidal tapering shape, viewed in cross-section relative to the longitudinal extension of the multipoint socket connector element 50.

Using SMD connections 62, an SMD contact can be formed for example on a printed-circuit board or a card in order to achieve screening of such connection. In the plugged condition, the screening sheets 64 are in direct contact with the multipoint socket connector element 50 and in flat contact with the portions of the screening sheets 30 that project into the receiving space 70.

The invention claimed is:

1. A plug-in connector for connecting electronic components, comprising a multipoint pin connector element and a multipoint socket connector element, which can be engaged one into the other and which form a plurality of electric signal conductors and at least one earth conductor, the multipoint pin connector element and the multipoint socket connector element being each provided with an electric screening in the form of at least one screening sheet that can be fixed on the multipoint pin connector element or the multipoint socket connector element, respectively, via snap-in connections, the screening sheets comprising soldered connections that project from the multipoint pin connector element and the multipoint socket connector element in the snapped-in condition and the respective screening sheets being in predominantly flat contact one with the other by their body surfaces facing each other, wherein the screening sheets of the multipoint pin connector element comprise at least two rows of snap-in connections that are arranged at a spacing one above the other, wherein the snap-in connections comprise first and second rows of hook-like projections formed on the screening sheets and first and second rows of openings formed in the multipoint pin connector element that are adapted to said projections, the hook-like projections in said first row of hook-like projections engaging in the openings in said first row of openings and the hook-like projections in said second row of hook-like projections engaging in the openings in said second row of openings, and wherein the hook-like projections of the screening sheet associated to the multipoint pin connector element project on both sides of the screening sheet in opposite direction so that they face away from each other.

2. The plug-in connector according to claim 1, wherein the screening sheets are arranged in receiving pockets which are adapted to them and which are formed in the multipoint pin connector element and that the screening sheets project from said receiving pockets so that they come to be positioned on the in sides of the receiving space.

3. The plug-in connector according to claim 1, wherein the hook-like projections are formed as an integral part of the screening sheet.

4. The plug-in connector according to claim 1, wherein SMD or THR contact elements are formed on the respective screening sheets for contacting the respective screening sheet with a printed-circuit board or the like.

5. The plug-in connector according to claim 1, wherein the screening sheets are formed as one single piece.

6. The plug-in connector according to claim 1, wherein the hook-like projections are formed as an integral part of the screening sheet.

7. The plug-in connector according to claim 1, wherein the multi-point pin connector element comprises a receiving space for the multipoint socket connector element.

8. The plug-in connector according to claim 7, wherein a first row of snap-in connections is arranged at the level of an entry opening of that receiving space and at least one further row of the snap-in connections is arranged at the level of the bottom surface that delimits the receiving space.

9. The plug-in connector according to claim 8, wherein the screening sheets are arranged in receiving pockets which are adapted to them and which are formed in the multipoint pin connector element and that the screening sheets project from said receiving pockets so that they come to be positioned on the in sides of the receiving space.

10. The plug-in connector according to claim 7, wherein the screening sheets are arranged in receiving pockets which are adapted to them and which are formed in the multipoint pin connector element and that the screening sheets project from said receiving pockets so that they come to be positioned on the in sides of the receiving space.

11. The plug-in connector according to claim 1, wherein the hook-like projections extend in the same direction in parallel one to the other.

12. The plug-in connector according to claim 11, wherein the hook-like projections are formed as an integral part of the screening sheet.

* * * * *